US010053954B2

(12) United States Patent
Stautzenberger et al.

(10) Patent No.: US 10,053,954 B2
(45) Date of Patent: Aug. 21, 2018

(54) CEMENTING A LINER USING REVERSE CIRCULATION

(71) Applicant: Halliburton Energy Services, Inc., Houston, TX (US)

(72) Inventors: Arthur Stautzenberger, Denton, TX (US); Richard Noffke, Frisco, TX (US); David Matus, Collin, TX (US); Odee Daigle, Sachse, TX (US); Ryan Humphrey, Dallas, TX (US); Stephen Maddux, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 3 days.

(21) Appl. No.: 14/778,891

(22) PCT Filed: Dec. 11, 2013

(86) PCT No.: PCT/US2013/074488
§ 371 (c)(1),
(2) Date: Sep. 21, 2015

(87) PCT Pub. No.: WO2015/088524
PCT Pub. Date: Jun. 18, 2015

(65) Prior Publication Data

US 2016/0281459 A1 Sep. 29, 2016

(51) Int. Cl.
*E21B 33/14* (2006.01)
*E21B 33/04* (2006.01)
(Continued)

(52) U.S. Cl.
CPC ..... *E21B 33/14* (2013.01); *E21B 33/04* (2013.01); *E21B 33/12* (2013.01); *E21B 34/10* (2013.01);
(Continued)

(58) Field of Classification Search
None
See application file for complete search history.

(56) References Cited

U.S. PATENT DOCUMENTS 3,223,159 A 12/1965 Brown
3,253,655 A 5/1966 Brown
(Continued)

FOREIGN PATENT DOCUMENTS

WO WO2012065126 5/2012

OTHER PUBLICATIONS

International Search Report and Written Opinion issued by the Korean Intellectual Property Office regarding International Application No. PCT/US2013/074488, dated Aug. 13, 2015, 12 pages.
(Continued)

*Primary Examiner* — Matthew R Buck
*Assistant Examiner* — Douglas S Wood
(74) *Attorney, Agent, or Firm* — Haynes and Boone, LLP

(57) ABSTRACT

A method for reverse circulation cementing of a liner in a wellbore extending through a subterranean formation is presented. A running tool with expansion cone, annular isolation device, and reverse circulation assembly is run-in with a liner. The annular isolation device is set against the casing. A valve, such as a dropped-ball valve, opens reverse circulation ports for the cementing operation. The liner annulus is cemented using reverse circulation. An expandable liner hanger, if present, is expanded into engagement with the casing. The running tool is released and pulled from the hole.

18 Claims, 5 Drawing Sheets

(51) Int. Cl.

| | |
|---|---|
| ***E21B 33/12*** | (2006.01) |
| ***E21B 34/10*** | (2006.01) |
| ***E21B 43/10*** | (2006.01) |
| ***E21B 7/26*** | (2006.01) |
| *E21B 34/00* | (2006.01) |

(52) U.S. Cl.
CPC ..... *E21B 43/10* (2013.01); *E21B 43/103* (2013.01); *E21B 2034/007* (2013.01)

(56) References Cited

U.S. PATENT DOCUMENTS

| | | | | |
|---|---|---|---|---|
| 3,346,050 | A | 10/1967 | Brown | |
| 4,854,386 | A | 8/1989 | Baker et al. | |
| 5,743,335 | A | 4/1998 | Bussear | |
| 7,108,080 | B2 * | 9/2006 | Tessari | E21B 7/20 175/21 |
| 2004/0099423 | A1 | 5/2004 | Badrak et al. | |
| 2004/0256157 | A1 | 12/2004 | Tessari et al. | |
| 2010/0051277 | A1 | 3/2010 | Chase et al. | |
| 2016/0160603 | A1 * | 6/2016 | Sevadjian | E21B 33/14 166/288 |

OTHER PUBLICATIONS

Supplementary European Search Report issued by the European Patent Office regarding EP Application No. 13899132, dated Mar. 24, 2017, 7 pages.

* cited by examiner

CEMENTING A LINER USING REVERSE CIRCULATION

CROSS-REFERENCE TO RELATED APPLICATION

This application is a U.S. National Stage Entry of International Application No. PCT/US2013/074488 filed Dec. 11, 2013, the entire disclosure of which is hereby incorporated herein by reference.

FIELD OF INVENTION

Generally, methods and apparatus are presented for reverse circulation cementing operations in a subterranean well. More specifically, reverse circulation cementing of a liner string below a liner hanger is presented.

BACKGROUND OF INVENTION

In order to produce hydrocarbons, a wellbore is drilled through a hydrocarbon-bearing zone in a reservoir. In a cased hole wellbore (as opposed to an open hole wellbore) a tubular casing is positioned and cemented into place in the wellbore, thereby providing a tubular between the subterranean formation and the interior of the cased wellbore. Commonly, a casing is cemented in the upper portion of a wellbore while the lower section remains open hole.

It is typical to "hang" a liner or liner string onto the casing such that the liner supports an extended string of tubular below it. Conventional liner hangers can be used to hang a liner string from a previously set casing. Conventional liner hangers are known in the art and typically have gripping and sealing assemblies which are radially expanded into engagement with the casing. The radial expansion is typically done by mechanical or hydraulic forces, often through manipulation of the tool string or by increasing tubing pressure. Various arrangements of gripping and sealing assemblies can be used.

Expandable liner hangers are used to secure the liner within a previously set casing or liner string. Expandable liner hangers are set by expanding the liner hanger radially outward into gripping and sealing contact with the casing or liner string. For example, expandable liner hangers can be expanded by use of hydraulic pressure to drive an expanding cone, wedge, or "pig," through the liner hanger. Other methods can be used, such as mechanical swaging, explosive expansion, memory metal expansion, swellable material expansion, electromagnetic force-driven expansion, etc.

It is also common to cement around a liner string after it is positioned in the wellbore. Running cement into the annulus around the liner is performed using conventional circulation methods. The disclosure addresses methods and apparatus for reverse circulation cementing of a liner.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

Figure 1:
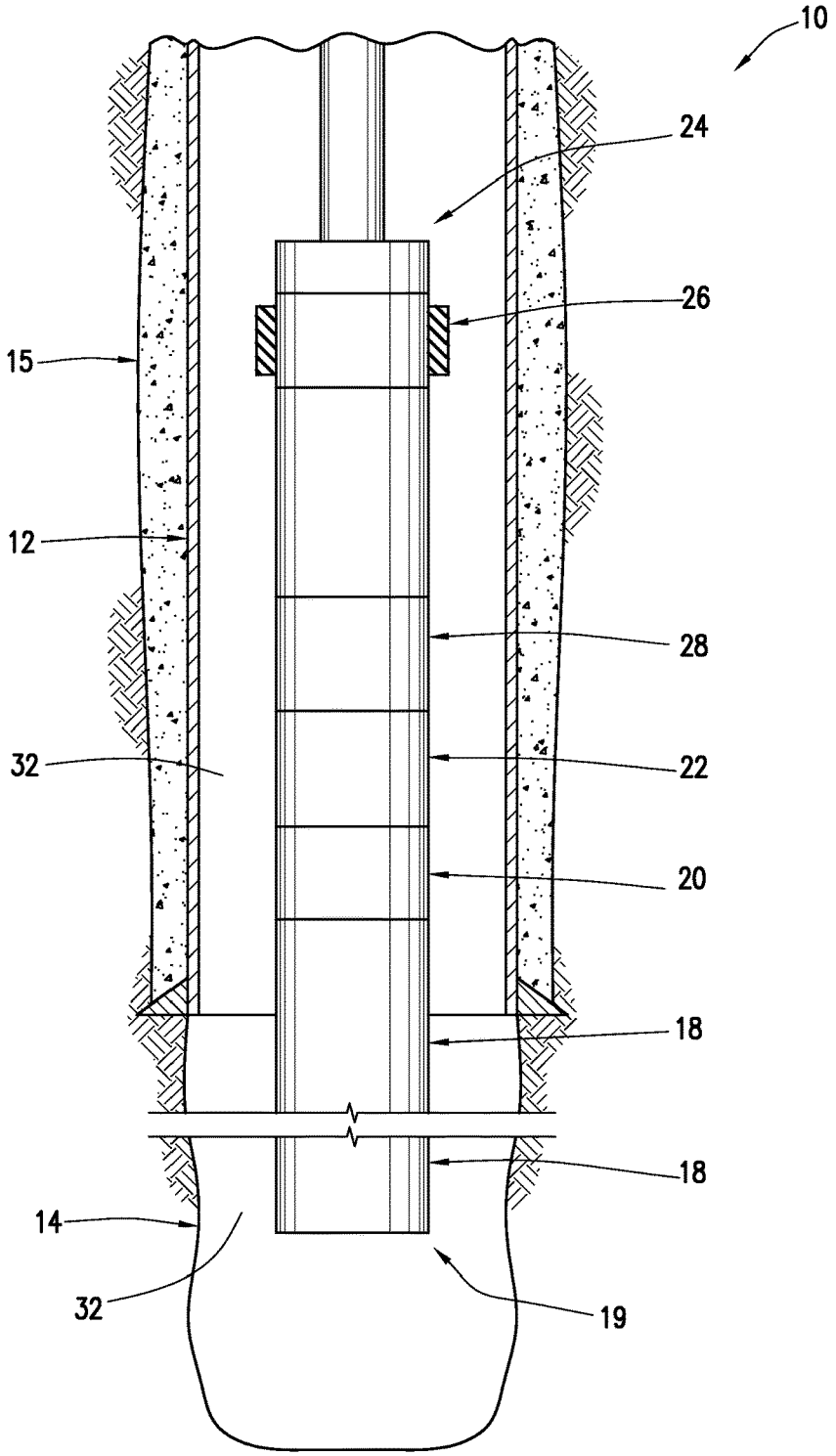
FIG. 1 is a schematic view of an exemplary reverse circulation cementing system according to an aspect of the embodiment during run-in to a wellbore.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention.

The description is primarily made with reference to a vertical wellbore. However, the disclosed embodiments herein can be used in horizontal, vertical, or deviated bores.

As used herein, the words "comprise," "have," "include," and all grammatical variations thereof are each intended to have an open, non-limiting meaning that does not exclude additional elements or steps. It should be understood that, as used herein, "first," "second," "third," etc., are arbitrarily assigned, merely differentiate between two or more items, and do not indicate sequence. Furthermore, the use of the term "first" does not require a "second," etc. The terms "uphole," "downhole," and the like, refer to movement or direction closer and farther, respectively, from the wellhead, irrespective of whether used in reference to a vertical, horizontal or deviated borehole.

The terms "upstream" and "downstream" refer to the relative position or direction in relation to fluid flow, again irrespective of the borehole orientation. Although the description may focus on a particular means for positioning tools in the wellbore, such as a tubing string, coiled tubing, or wireline, those of skill in the art will recognize where alternate means can be utilized. As used herein, "upward" and "downward" and the like are used to indicate relative position of parts, or relative direction or movement, typically in regard to the orientation of the Figures, and does not exclude similar relative position, direction or movement where the orientation in-use differs from the orientation in the Figures.

As used herein, "tubing string" refers to a series of connected pipe sections, joints, screens, blanks, cross-over tools, downhole tools and the like, inserted into a wellbore, whether used for drilling, work-over, production, injection, completion, or other processes. Similarly, "liner" or "liner string" and the like refer to a plurality of tubular sections, potentially including downhole tools, landing nipples, isolation devices, screen assemblies, and the like, positioned in the wellbore below the casing.

The disclosure addresses cementing a liner in a wellbore using reverse circulation for the cementing. More specifically, a method of reverse cementing of the liner is provided in conjunction with running in and setting of a conventional liner hanger or expandable liner hanger (ELH).

The embodiments discussed herein focus primarily on hydraulically actuated tools, including a running tool for setting or radially expanding an ELH, setting a radially expandable annular isolation device (such as a packer), operating downhole tools such as valves, sliding sleeves, collet assemblies, release and connection of tools downhole, etc. It is understood however that mechanical, electrical, chemical, and/or electro-mechanical operation can be used to actuate downhole tools and mechanisms. Actuators are used to "set" tools, release tools, open or close valves, etc. Here, a tubing string is run into a partially cased wellbore to hang an expandable liner, cement around the liner, hang the liner by radial expansion of an ELH, and release or disconnect the hung liner from the tool string. The string is retrieved to the surface.

Further, the disclosure focuses on reverse cementing of a liner in conjunction with an ELH. Those of skill in the art will recognize that the methods and apparatus disclosed can be readily modified for use with conventional liner hangers. For example, the various circulation control ports disclosed herein can be used to control circulation flow paths during run-in to hole, setting of the packer, reverse cementing, and pull out of hole. Where the disclosure relates to expansion of the ELH using an expansion assembly and cone, a conventional liner hanger embodiment can, for example, use the same or similar flow path diversion to set the conventional liner hanger. Alternately, the conventional liner hanger can be set, hydraulically or mechanically, using known methods and apparatus in the art.

Conventional liner hangers are typically secured within a wellbore by toothed slips set by axial translation with respect to the liner hanger mandrel or housing. As the slips are translated, they are moved radially outward, often on a ramped surface. As the slips move radially outward, they grippingly engage the casing. This type of arrangement is shown, for example, in which slips are radially expanded by riding up over cone elements disposed into the tubular body of the central mandrel. For disclosure regarding conventional liner hangers, see, for example, U.S. Pat. Nos. 8,113,292, to 8,113,292, published Feb. 14, 2012; U.S. Pat. No. 4,497,368, to Baugh, issued Feb. 5, 1985; U.S. Pat. No. 4,181,331, to Armco Inc., published Jan. 1, 1980; U.S. Pat. No. 7,537,060, to Fay, issued May 26, 2009; U.S. Pat. No. 8,002,044, to Fay, issued Aug. 23, 2011; each of which are incorporated herein in their entirety for all purposes. Features of these conventional liner hangers can be used in conjunction with the disclosed apparatus and methods herein.

FIG. 1 is a schematic view of an exemplary reverse circulation cementing system according to an aspect of the embodiment shown being run into a wellbore. More specifically, FIG. 1 is a schematic of a wellbore system generally designated 10, having a cased portion with casing 12 positioned therein to a certain depth and an uncased or open hole wellbore 14 portion below. The casing 12 is cemented 15 in position in the annulus defined between the casing and wellbore. A tubing string 24 is run into the hole as shown and includes a liner or liner string 18, an expandable liner hanger (ELH) 20, a running or setting tool 22, a tubing string 24, an annular isolation device 26, and a reverse circulation tool 28.

Make-up and running of tubing strings, liner hangers, liners, etc., is known in the art by those of ordinary skill and will not be discussed in detail. During run in, conventional circulation is employed such that fluid pumped down the interior passageway 30 of the tubing string 24, including through passageway sections defined in the running tool, ELH, liner, etc. Fluid exits the bottom 19 of the liner and circulates back to the surface (or a given depth uphole, such as at a cross-over tool) along the tubing annulus 32 defined generally between the tubing string 24 and the casing 12 and again between the liner 18 and wellbore 14. The tubing string is run-in to a selected position with the ELH 20 adjacent the casing 12 and the liner 18 extending into the open hole wellbore 14.

Figure 2:
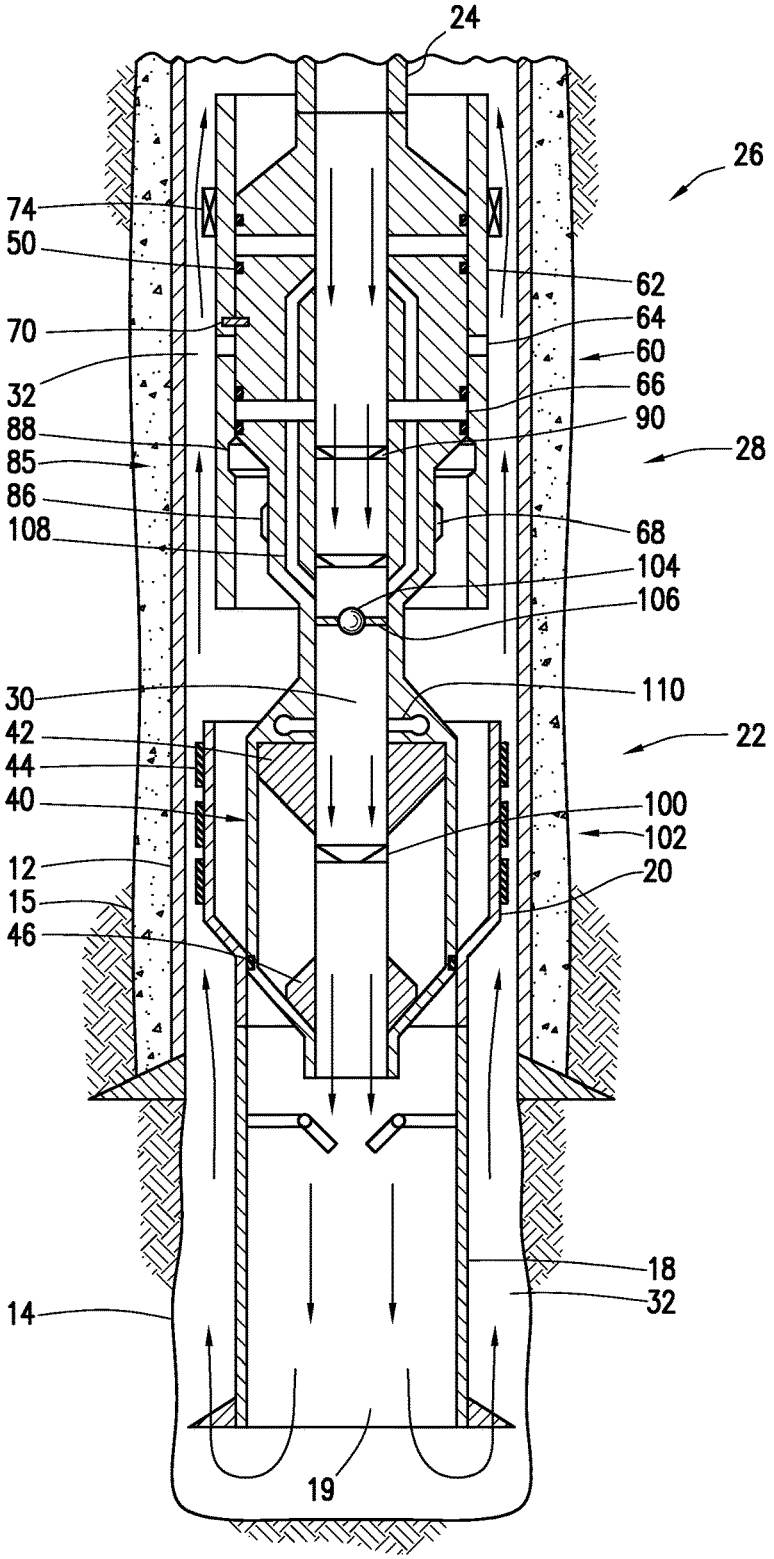
FIG. 2 is a schematic of an exemplary embodiment of a tool string positioned in a wellbore and having a reverse cementing tool assembly according to the disclosure, wherein the assembly in a run-in position.
Figure 3:
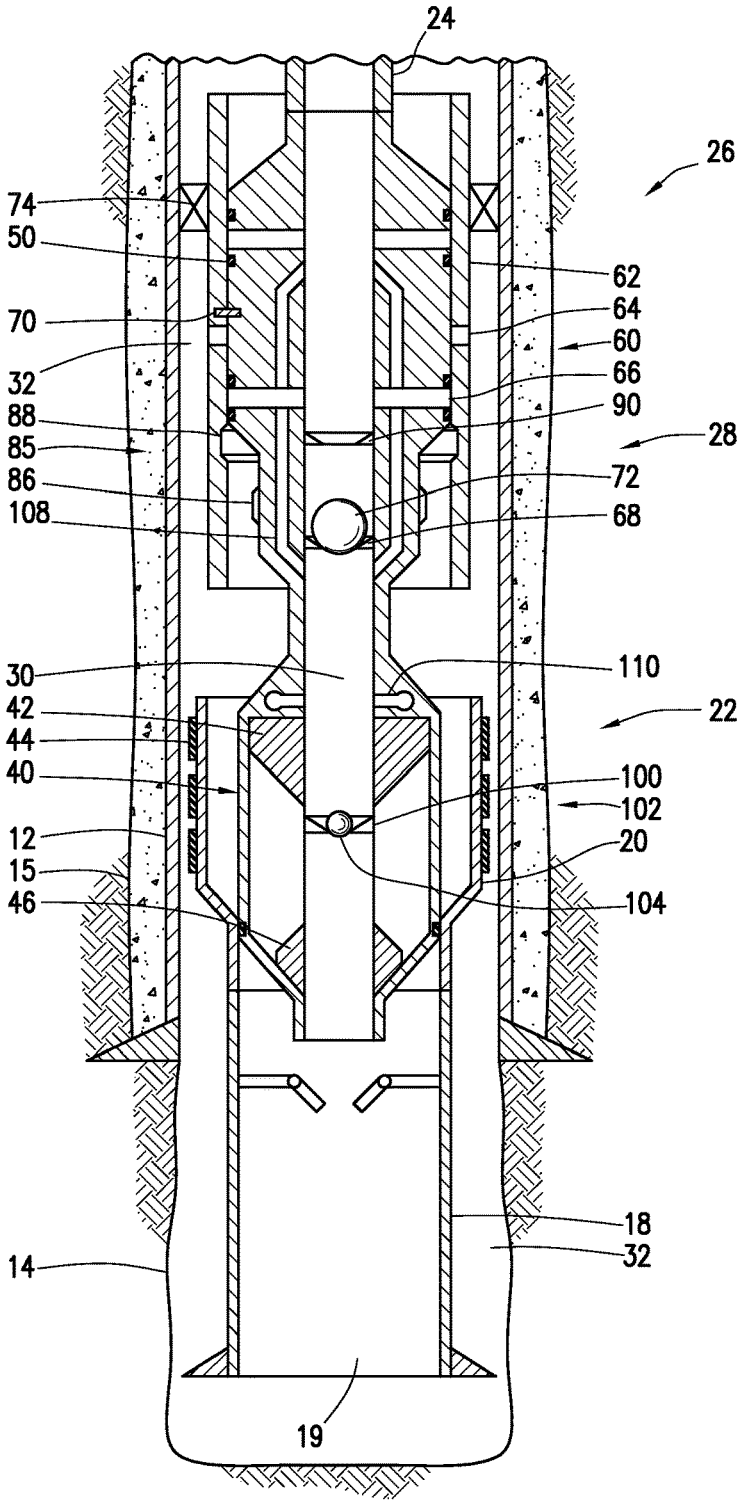
FIG. 3 is a schematic of an exemplary embodiment of a tool string positioned in a wellbore and having a reverse cementing tool assembly according to the disclosure with the annular isolation device in a set position.
Figure 4:
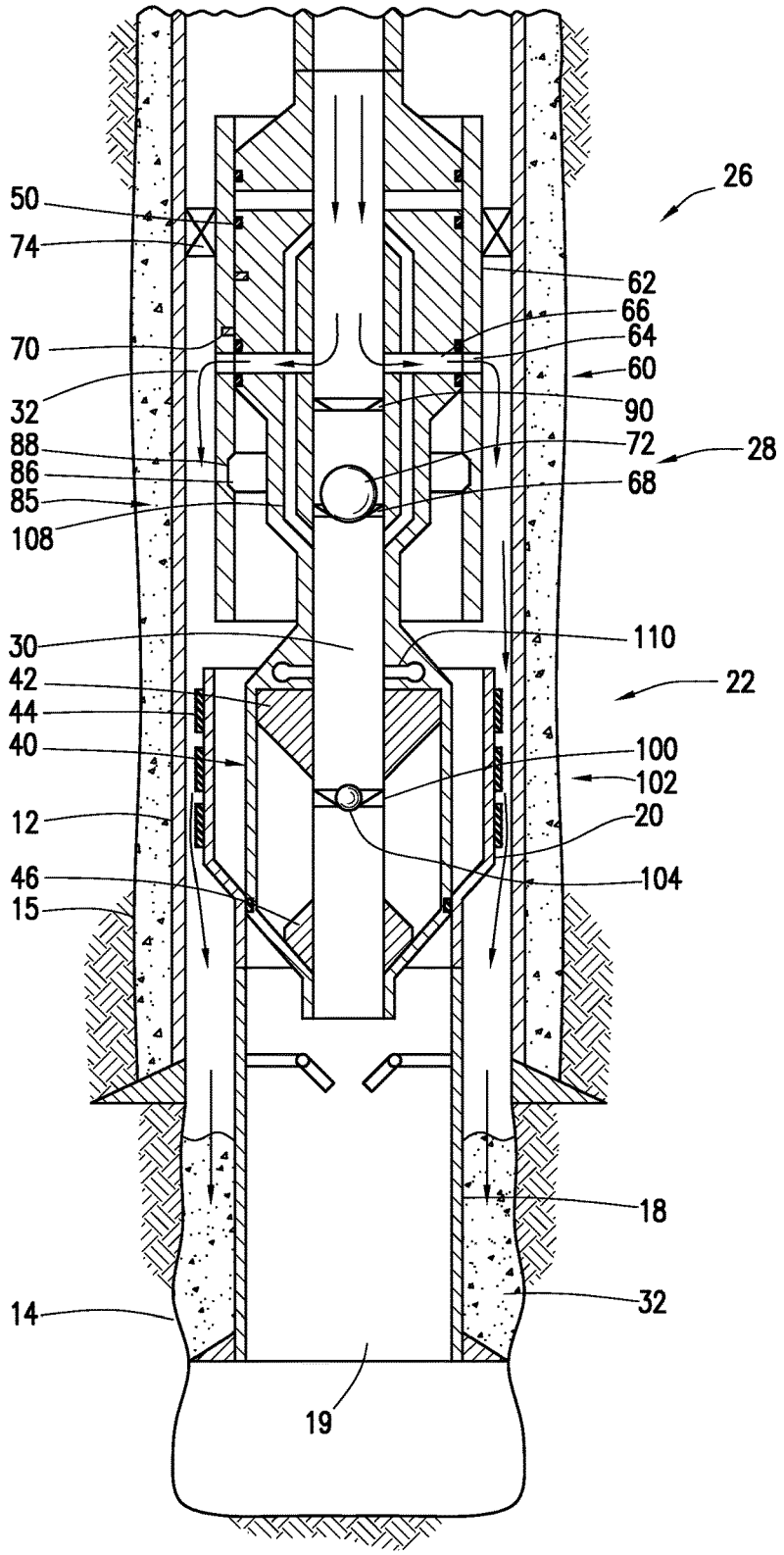
FIG. 4 is a schematic of an exemplary embodiment of a tool string positioned in a wellbore and having a reverse cementing tool assembly according to the disclosure with the reverse circulation cementing tool in an open position.
Figure 5:
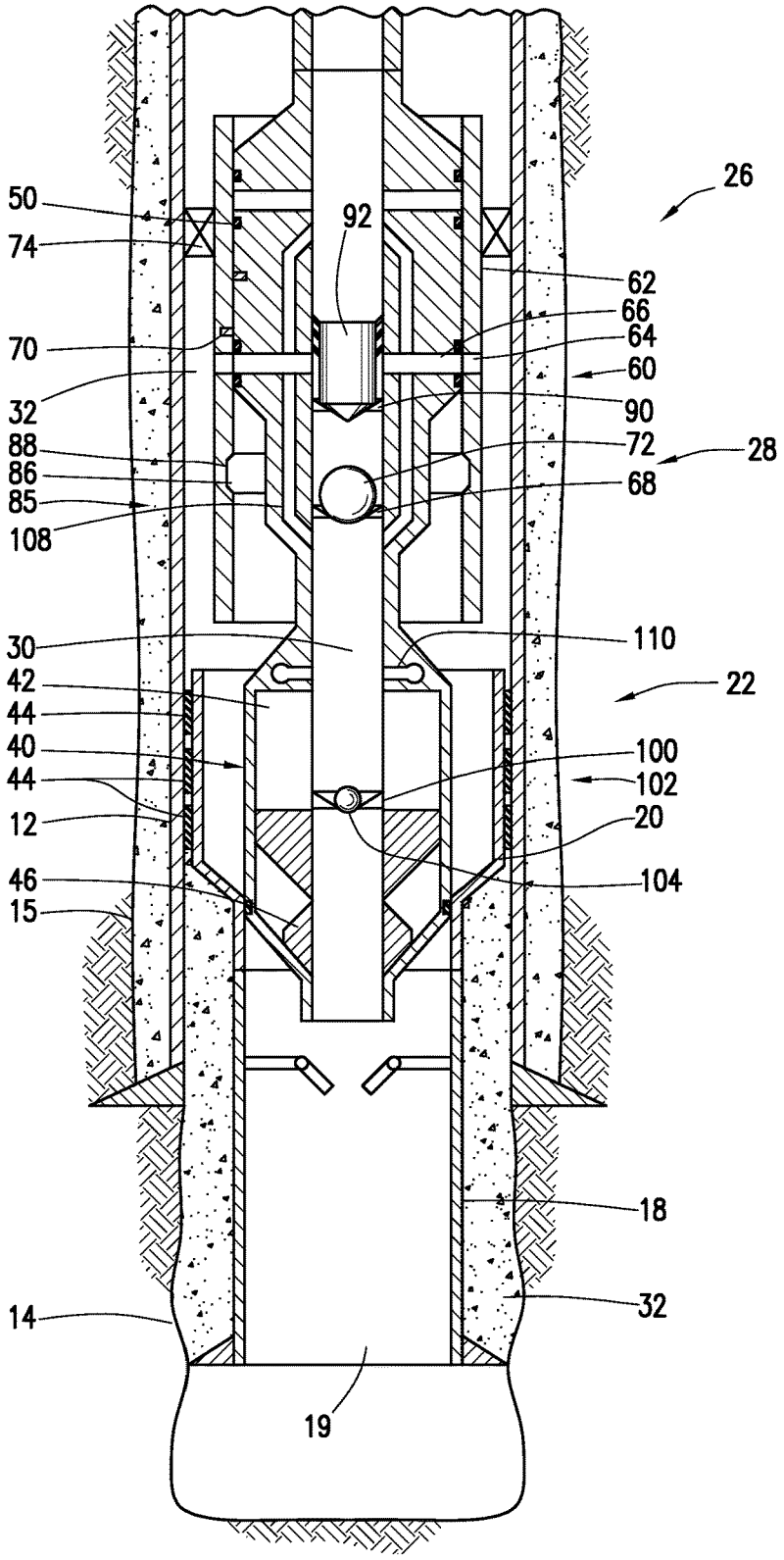
FIG. 5 is a schematic of an exemplary embodiment of a tool string positioned in a wellbore and having a reverse cementing tool assembly according to the disclosure with the expandable liner hanger in a set position.

FIGS. 2-5 are schematics of an exemplary embodiment of a tool string positioned in a wellbore and having a reverse cementing tool assembly according to the disclosure. The system is in a first or run-in position in FIG. 2, wherein conventional circulation is permitted along a fluid path defined downwardly through the interior passageway 30 (or string ID), out the bottom 19 of the liner 18, and upwards along the tubing annulus 32. FIG. 3 is a schematic of an exemplary embodiment of a tool string positioned in a wellbore and having a reverse cementing tool assembly according to the disclosure with the annular isolation device in a set position. FIG. 4 is a schematic of an exemplary embodiment of a tool string positioned in a wellbore and having a reverse cementing tool assembly according to the disclosure with the reverse circulation cementing tool in an open position. FIG. 5 is a schematic of an exemplary embodiment of a tool string positioned in a wellbore and having a reverse cementing tool assembly according to the disclosure with the expandable liner hanger in a set position.

The running tool 22 includes, in a preferred embodiment, a radial expansion assembly 40 having an expansion cone 42 operated by hydraulic pressure communicated through the internal passageway 30 upon increasing tubing pressure. An increase in tubing pressure, when flow through the expansion tool ID is blocked, drives the expansion cone through the ELH, thereby radially expanding the ELH into gripping and sealing engagement with the casing 12. Expansion assemblies are known in the art by those of ordinary skill and will not be described in detail herein or shown in detail in the figures. The expansion assembly can include additional features, such as selectively openable ports, fluid passageways, rupturable or frangible disks, piston assemblies, force multipliers, radially enlargeable expandable cones, fluid flow metering systems, etc.

The ELH 20 includes a plurality of annular sealing and gripping elements 44 which engage the casing 12 when the ELH is in a radially expanded position, as seen in FIG. 5. The elements 44 can be of elastomeric, metal, or other material, can be of various design, and can comprise separate sealing elements and gripping elements. The ELH 20 can include additional features and devices, such as cooperating internal profiles, shear devices (e.g., shear pins), releasable connect or disconnect mechanisms to cooperate with the running tool, etc. The liner or liner string is attached to and extends downwardly from the ELH. The liner string can include various tools and assemblies as are known in the art.

The running tool 22 also preferably includes a release assembly or disconnect assembly 46 for selectively disconnecting the running tool 22 from the ELH 20. The release assembly 46 maintains the ELH and running tool in a connected state during run-in hole and radial expansion of the ELH. Upon completion of the operation, the locking assembly can be selectively disconnected, thereby allowing the running tool to be retrieved, or pulled out of hole, on the tubing string 24. The locking assembly, or disconnect assembly, can include a collet assembly, sliding sleeves, prop sleeves, cooperating lugs and recesses, snap rings, etc., as are known in the art.

The tubing string 24 preferably includes an annular isolation device 26 for sealingly engaging the casing 12. During run-in, the annular isolation device is in a low radial profile position. Upon reaching target depth, the annular isolation device is radially expanded, as seen in FIG. 2, into sealing engagement with the casing. The annular isolation device holds against pressure differential across the device, and prevents fluid flow through the annulus 32. In a preferred embodiment, the annular isolation device comprises a packer. Other such devices include packers, swellable packers, inflatable packers, chemically and thermally activated packers, plugs, bridge plugs, and the like, as are known in the art.

The annular isolation device seen in the figures is hydraulically actuated using tubing pressure applied through annular isolation device ports 50. In some embodiments, the ports 50 are aligned with sliding sleeve ports defined in a sliding sleeve during run-in and actuation. The ports 50 can then be closed after actuation of the annular isolation device by shifting of the sliding sleeve. Other embodiments do not close these ports, especially where the annular isolation device includes a mechanism for staying in the set position, such as a ratchet, latch, lock, etc. Preferably, the annular isolation device 26 is retrievable; that is, the device can be selectively "un-set" to a low radial profile position for pulling out of the hole. Retrievable packers are known in the art and can be released mechanically, such as by tubing string manipulation, hydraulically by application of tubing pressure, and otherwise.

In FIG. 2, the annular isolation device is in a first or run-in position. When flow through the ID passageway 30 is blocked, such as by a first drop-ball 72 positioned onto drop-ball valve seat 68, an increase in tubing pressure communicated through ports 50 actuates and radially expands the annular isolation device to the set position, as seen in FIG. 3. In the set position, the isolation device grippingly and sealingly engages the casing and creates an effective fluid differential pressure barrier in the annulus. Annular isolation devices are known in the art and typically have gripping and sealing assemblies which are radially expanded into engagement with the casing. The radial expansion can be done by mechanical, hydraulic, electro-mechanical, etc., actuation. Various arrangements of gripping and sealing assemblies can be used, for example, having slips, slip assemblies, frangible or pre-separated slips, both slips and separate sealing elements, combined sealing and gripping elements, integral or inserted teeth, multiple sealing or gripping elements, etc. Isolation devices are set by expanding the sealing and gripping elements radially outward into gripping and sealing contact with the casing.

Alternately, the annular isolation device ports can include one or more valves which are movable between closed and open positions to allow setting of the device. The valves can be mechanically, electrically, electro-mechanically, hydraulically, chemically, or thermally operated. The valves can be remotely operated by wireless or wired signal, by an increase in tubing pressure, passage of time (e.g., a dissolving disk), mechanical operation (e.g., manipulation of the tubing string), etc. The valves can have a sliding sleeve, rotating valve element, frangible or rupturable disk, a check valve or floating valve, etc., as is known in the art.

The reverse cementing tool assembly 28 is discussed with regard to FIGS. 2-5, each of which show the exemplary tool in sequential positions or states. Like numbers refer to like parts throughout.

The exemplary reverse cementing tool 28 seen in the figures comprises a valve assembly 60 having a tubular 62 defining reverse circulation ports 64, reverse circulation passageways 66 defined in the reverse circulation cementing tool, a drop-ball valve seat 68, optional seat 90, and having a release mechanism 70 (e.g., shear pins) selectively attaching the annular isolation device 26 to the tubing string 24, a mechanically operable latching mechanism 85 (such as cooperating profiles 86 and 88), and drop-ball 72. The valve assembly is seen in a first or run-in position in FIG. 3.

The valve assembly 60, in a preferred embodiment, is mechanically operated such as by manipulation of the tool string. Those of skill in the art will recognize other means and methods for operating such a valve assembly, such as by using hydraulics, tubing pressure, electro-mechanical devices, etc.

The string 24 is pulled upward after the isolation device 26 is set, actuating the release mechanism 70 (e.g., shear pins). After release, the string 24, including tubular 62, is free to move relative to the isolation device 26. The tubular 62 is moved uphole until the latching mechanism 85 is actuated.

The latching mechanism 85 is shown as including cooperating profiles 86 on the reverse cementing tool and profile 88 defined in the isolation device 26. The latching mechanism or cooperating profiles can be positioned elsewhere. The latching mechanism can be any latching or landing method or apparatus known in the art, with the embodiment shown being exemplary. The latching mechanism can include radially expandable and/or retractable members. The latching mechanism can include, for example, snap rings, cooperating profiles or shoulders, interconnected or telescoping sleeves, cooperating pins and slots (e.g., J-slots), shear mechanisms, collet assemblies, dogs, lugs or the like, etc. If desired, in some embodiments selective release of the string can be achieved through mechanisms and methods known in the art, such as, for example, increasing tubing pressure, manipulation of the tubing string (e.g., weight down, rotation), electro-mechanical devices (battery or cable powered) upon an activation signal (wireless or wired), chemically or thermally activated mechanisms or barriers, etc.

With the latching mechanism activated, thereby attaching the string and isolation device, and with a ball 72 seated at valve seat 68, the reverse circulation ports 64 and reverse circulation passageways 66 are aligned allowing fluid flow therethrough into the annulus 32. Cement and other fluids flow from the interior passageway 30 above the valve seat 68 into the tubing annulus 32. The cement flows down the annulus 32 toward the lower end of the liner 18.

In a preferred embodiment, a one way valve 89 is positioned in the passageway 30 below the liner hanger. During reverse circulation cementing, the cement and other fluids will close the one-way valve 89 preventing further fluid flow upward through the passageway 30.

Alternately, a return flow path can be provided. For example, return and bypass ports can be opened allowing fluid flow upward through the tool string or its members, bypassing the seated ball 72 and the annular seal provided by the isolation device 26. Flow can be directed through a combination of passageways interior to the string and cementing tool and the annulus 32 above the isolation device. Alternate arrangements of bypass passageways and ports will be readily apparent to those of skill in the art. For example, the bypass passageway can be annular, have multiple passageways, be housed inside the tubing, etc.

The reverse cementing tool 28 is designed to alter a conventional circulation path to a reverse circulation path. The liner is cemented using the reverse circulation path by pumping cement down the tubing interior passageway, past the isolation device, and into the tubing annulus below the isolation device. The cement and other pumped fluids are forced downward along the annulus to the bottom of the wellbore and thence through the lower end of the liner and upward along the interior passageway. The interior passageway is closed or closable at one-way valve 89, at valve seat 68, or at another valve positioned in the passageway. It is understood that the one-way valve, ball-drop valves, and other valves herein can be interchanged in many cases with various other valve types known in the art and as will be apparent to one of skill in the art. The valves, depending on their use, can be check valves, one-way valves, or frangible barriers, for example. The reverse circulation assembly can optionally be closed upon completion of cementing operations and the tool placed into a conventional circulation pattern.

Cementing operations are known in the art and not described in detail herein. Cement 84 is pumped into the annulus 32 around the liner 18 where it will set. The liner is cemented into position in the wellbore 14. "Cement" as used herein refers to any substance, whether liquid, slurry, semi-solid, granular, aggregate, or otherwise, used in subterranean wells to fill or substantially fill an annulus surrounding a casing or liner in a wellbore which sets into a solid material, whether by thermal, evaporative, drainage, chemical, or other processes, and which functions to maintain the casing or liner in position in the wellbore. Cementing materials are known in the art by persons of skill.

The string is maintained in the reverse circulation position during cementing. The string can be maintained in the second position by various mechanisms known in the art for selectively and releasably supporting elements in relation to one another while allowing fluid flow therethrough. For example, snap rings, cooperating profiles or shoulders (e.g., profiles 86), interconnected or telescoping sleeves, cooperating pins and slots (e.g., J-slots), shear mechanisms, collet assemblies, dogs, lugs or the like, etc. Selective release of the sleeve can be achieved through mechanisms and methods known in the art, such as, for example, increasing tubing pressure, manipulation of the tubing string (e.g., weight down, rotation), electro-mechanical devices (battery or cable powered) upon an activation signal (wireless or wired), chemically or thermally activated mechanisms or barriers, etc.

In a preferred method, a cement dart 92 is run through the tubing string interior passageway 30 upon completion of cementing. Running of a dart is typical at the end of a cement job. The dart 92 seats on a valve seat 90. The dart operates to close access to the reverse cementing ports 64. In a preferred embodiment, the dart simply blocks the reverse circulation passageways 66. Alternately, the dart can block flow to actuate a tubing pressure operated valve, such as a sliding sleeve, to close the reverse circulation ports. In other embodiments, the drop-ball 72, dart 92, additional drop-balls, etc., are removed from the interior passageway. These devices can be removed by any known method of the art, including but not limited to reverse flow to the surface, mechanical release from or extrusion through the valve seat and movement to the wellbore bottom or other convenient location, dissolving or chemically dispersing the ball, etc. Removal of the drop-balls and dart opens the interior passageway 30 to fluid flow and allows communication of tubing pressure. Other methods and apparatus for closing the reverse circulation ports will be recognized by those of skill in the art.

In a preferred embodiment, the ELH is radially expanded into sealing engagement with the casing upon completion of the cementing operation. This can be accomplished in many ways, as those of skill in the art will recognize. In a preferred embodiment, an expansion cone 42 is hydraulically driven through the ELH by increasing tubing pressure to operate one or more piston assemblies (not shown). Such an assembly is known in the art and can include various other features and mechanisms such as metering devices, force multipliers, stacked piston assemblies, etc. Expandable Liner Hangers and setting equipment and services are commercially available through Halliburton Energy Services, Inc.

In one embodiment, a drop-ball, dart, or caged ball 104 is moved to a seated position on a valve seat 100 defined in the expansion assembly 32, thereby allowing a pressure-up of the tubing fluid to drive the expansion cone 42. For example, an expansion valve assembly 102 can be used. An exemplary valve has a valve seat 100 onto which is positioned a caged ball 104 carried initially in the running tool. The caged ball is released from its run-in position, in which fluid freely moves past the caged ball, as seen in FIG. 2, and moved to a seated position on valve seat 100 in the expansion assembly. The caged ball 104 can be released at any of several times during operation, but in a preferred embodiment is released when the drop-ball 72 is placed in the assembly. The drop ball can mechanically force the caged ball to extrude through or be released from its initial and temporary seat 106.

Alternately, the drop ball 72 can operate a valve such as a sliding sleeve valve, thereby allowing tubing pressure to act on the caged ball or its cage, thereby releasing the caged ball. For example, ball 72, once seated at seat 68 can direct tubing pressure or fluid along bypass passageways 108. Tubing pressure then forces the caged ball 104 to drop to its secondary seat 100 in the expansion assembly, thereby blocking fluid flow through the interior passageway 30 in the expansion assembly. Once seated, tubing pressure is diverted to actuate the isolation device.

Upon completion of cementing and placement of the dart 92, tubing fluid is diverted through bypass passageways 108. Fluid bypasses the seated dart 92 and ball 72 and pressure is applied through expansion assembly ports 110. The fluid pressure is communicated to an actuation assembly, such as a piston assembly, which drives the expansion cone 42 downwardly through the ELH, thereby radially expanding the ELH to the set position seen in FIG. 5.

The caged ball can be carried in a side-pocket defined in the tubing string, in a tool positioned above the expansion cone for that purpose, in a cage which allows fluid flow past the ball, etc. Caged and releasable balls are known in the art by those of requisite skill. The caged ball can be released by methods and apparatus known in the art, including but not limited to, hydraulically, mechanically, electro-mechanically, or chemically or thermally actuated mechanisms, by removal or dissolution of a caging element, upon wireless or wired command, powered by local battery or remote power supply by cable, etc.

After completion of radial expansion of the ELH, as seen in FIG. 5, it may be desirable to establish a flow path allowing fluid to flow downward through the interior passageway 30 and through cross-over ports in the tubing wall into the annulus 32 above the now-expanded ELH. Fluid can then flow upward in the annulus 32 towards the surface. The fluid can bypass the still set annular isolation device 26 through bypass passageways. In other embodiments, sliding movement of a sleeve can open a previously closed bypass port allowing tubing fluid and pressure to be conveyed through a bypass passageway to a similar port above the expansion assembly. In an exemplary embodiment, the expansion cone 42 is stroked to expand the ELH and, at or near the end of its stroke, opens a cross-over port in the tubing wall allowing fluid communication to the annulus 32. Alternative arrangements, ports, actuation methods and devices, etc., will be apparent to those of requisite skill. Fluid can be communicated through the bypass ports and bypass passageway, thereby bypassing the drop-ball 72 and/or dart 92.

In preferred embodiments, the expansion tool, reverse circulation cementing tool, and string are retrievable. In one embodiment, the string is pulled from the surface and the upward force acts to release the isolation device from its set position. Further pulling of the string removes the string and tools from the wellbore, leaving the ELH and liner in place. Alternate arrangements will be apparent to those of skill in the art, such as, for example, actuating a release assembly to disconnect the string from the isolation device (which then remains in the hole), actuating a release assembly 46 to disconnect the expansion tool from the expanded liner hanger, etc. These mechanisms and methods are known in the art and not described herein in detail.

The embodiments disclosed present several valve assemblies for controlling fluid and pressure communication, for opening and/or closing valves, and for providing or denying access to fluid bypasses and annulus. Some of the valve assemblies are sliding sleeve valves and dropped or released ball valves. It is understood that the valve assemblies in the figures can often be replaced with other types of valve. Check valves, rupture disk, frangible disk, and other removable barrier valves, one-way and two-way valves, flapper valves, etc., as are known in the art can be used for some or all of the valves in the figures. Sliding sleeve valves arrangements will be readily apparent to those of skill in the art, including sliding sleeve valves wherein the ball valve element remains in a stationary seat and diverts flow to operate a separate sliding sleeve, etc.

Additionally, various actuation or activation methods and mechanisms are known in the art and can be employed at various locations, as those of skill will recognize. The valves can be operable by hydraulic, mechanical, electro-mechanical, chemically or thermally triggered valves can be used. The valves can be triggered or actuated in response to wireless or wired signal, time delays, chemical agents, thermal agents, electro-mechanical actuators such as movable pins, string manipulation, tubing pressure, flow rates, etc., as those of requisite skill will recognize. The valves in the figures are largely hydraulically operated by changes in tubing pressure. Some valves can be a removable barrier or disk valve, an electro-mechanical valve, or a check valve of some kind.

Further, multiple ports are called out in the figures. Ports are known in the art and can take various shape and size, can include flow regulation devices such as nozzles and orifices, and can have various closure mechanisms (e.g., pivoted cover).

Still further, various bypasses and passageways are described in relation to the figures. Those of requisite skill will recognize that the locations of the passageways and ports thereto, the shapes and paths of the passageways, and other passageway characteristics can take various forms. Such passageways can be annular, substantially tubular, or of other shape.

Where a conventional liner hanger is employed, the valve 212, expansion assembly 226, and/or valve 214 may be unnecessary or can be replaced with different valve and tool arrangements. For example, after cementing is complete, the valve 210 is closed (just as in the ELH version) and fluid pressure conveyed through a liner hanger setting passageway to the conventional liner hanger setting tool. For example, the fluid pressure can operate or actuate an axial compression of a slip and/or sealing element assembly, thereby causing radial expansion of the slips and sealing element into engagement with the casing. Alternate embodiments will be apparent to those of skill in the art.

The PCT Patent Application Nos. PCT/US2013/059324, filed Sep. 11, 2013, and PCT/US2013/064018, filed Oct. 9, 2013, are hereby incorporated herein in their entirety for all purposes including support of the claims as presented or as later amended. The reference provides detailed description of operation of tool and system parts and alternative arrangements.

The tools, assemblies and methods disclosed herein can be used in conjunction with actuating, expansion, or other assemblies. For further disclosure regarding installation of a liner string in a wellbore casing, see U.S. Patent Application Publication No. 2011/0132622, to Moeller, which is incorporated herein by reference for all purposes.

For further disclosure regarding reverse circulation cementing procedures and tools, see U.S. Pat. No. 7,252,147, to Badalamenti, issued Aug. 7, 2007; U.S. Pat. No. 7,303,008, to Badalamenti, issued Dec. 4, 2007; U.S. Pat. No. 7,654,324, to Chase, issued Feb. 2, 2010; U.S. Pat. No. 7,857,052, to Giroux, issued Dec. 28, 2010; U.S. Pat. No. 7,290,612, to Rogers, issued Nov. 6, 2007; and U.S. Pat. No. 6,920,929, to Bour, issued Jul. 26, 2005; each of which is incorporated herein by reference in its entirety for all purposes.

For disclosure regarding expansion cone assemblies and their function, see U.S. Pat. No. 7,779,910, to Watson, which is incorporated herein by reference for all purposes. For further disclosure regarding hydraulic set liner hangers, see U.S. Pat. No. 6,318,472, to Rogers, which is incorporated herein by reference for all purposes. Also see, PCT Application No. PCT/US12/58242, to Stautzenberger, and U.S. Pat. No. 6,702,030; PCT/US2013/051542, to Hazelip, filed Jul. 22, 2013; U.S. Pat. No. 6,561,271, to Baugh, issued May 13, 2003; U.S. Pat. No. 6,098,717, to Bailey, issued Aug. 8, 2000; and PCT/US13/21079, to Hazelip, Filed Jan. 10, 2013; each of which are incorporated herein by reference in their entirety for all purposes.

Further disclosure and alternative embodiments of release assemblies for running or setting tools are known in the art. For example, see U.S. Patent Publication 2012/0285703, to Abraham, published Nov. 15, 2012; PCT/US12/62097, to Stautzenberger, filed Oct. 26, 2012; each of which is incorporated herein in their entirety for all purposes, and references mentioned therein.

Running or setting tools, including setting assemblies, release assemblies, etc., are commercially available from Halliburton Energy Services, Inc., Schlumberger Limited, and Baker-Hughes Inc., for example.

Further disclosure relating to downhole force generators for use in setting downhole tools, see the following, which are each incorporated herein for all purposes: U.S. Pat. No. 7,051,810 to Clemens, filed Sep. 15, 2003; U.S. Pat. No. 7,367,397 to Clemens, filed Jan. 5, 2006; U.S. Pat. No. 7,467,661 to Gordon, filed Jun. 1, 2006; U.S. Pat. No. 7,000,705 to Baker, filed Sep. 3, 2003; U.S. Pat. No. 7,891,432 to Assal, filed Feb. 26, 2008; U.S. Patent Application Publication No. 2011/0168403 to Patel, filed Jan. 7, 2011; U.S. Patent Application Publication Nos. 2011/0073328 to Clemens, filed Sep. 23, 2010; 2011/0073329 to Clemens, filed Sep. 23, 2010; 2011/0073310 to Clemens, filed Sep. 23, 2010; and International Application No. PCT/US2012/51545, to Halliburton Energy Services, Inc., filed Aug. 20, 2012.

For disclosure regarding actuating mechanisms for use, for example, in rupturing a frangible barrier valve, see U.S. Patent Application Publication No. 2011/0174504, to Wright, filed Feb. 15, 2010; U.S. Patent Application Publication No. 2011/0174484, to Wright, filed Dec. 11, 2010; U.S. Pat. No. 8,235,103, to Wright, issued Aug. 7, 2012; and U.S. Pat. No. 8,322,426, to Wright, issued Dec. 4, 2012; all of which are incorporated herein by reference for all purposes.

In preferred embodiments, the methods described here and elsewhere herein are disclosed and support method claims submitted or which may be submitted or amended at a later time. The acts listed and disclosed herein are not exclusive, not all required in all embodiments of the disclosure, can be combined in various ways and orders, repeated, omitted, etc., without departing from the spirit or the letter of the disclosure. For example, disclosed is an exemplary method of reverse circulation cementing of a liner in a wellbore extending through a subterranean formation, the method comprising the steps of: a) running-in a tubing string having a reverse circulation assembly, and a liner; b) circulating fluid conventionally during run-in; c) setting an annular isolation device in an annulus defined between a casing positioned in the wellbore and the tubing string; d) flowing cement along a reverse circulation path into the annulus below the annular isolation device and adjacent the liner; and e) setting a liner hanger into engagement with the casing. 2. The method of claim 1, further comprising the step of e) setting the cement in the wellbore annulus about the liner. 3. The method of claim 1-2, wherein step c) further comprises setting a radially expandable annular isolation device in the wellbore annulus. 4. The method of claim 3, wherein the annular isolation device is set at a location in the wellbore having a casing, and wherein the annular isolation device is radially expanded to seal the wellbore annulus between the casing and the tubing string. 5. The method of claims 3-4, wherein the step of setting the annular isolation device further comprises the step of increasing tubing pressure to set the annular isolation device. 6. The method of claims 1-5, wherein step b) further comprises flowing fluid from the surface through the interior passageway, through an outlet at the liner bottom, and uphole along the wellbore annulus to the surface. 7. The method of claims 1-6, wherein step d) further comprises flowing fluid downhole through the interior passageway of the tubing string, into the wellbore annulus from the reverse circulation assembly, and downhole from the annular isolation device along the wellbore annulus and along the liner. 8. The method of claims 1-7, wherein step d) further comprises opening a reverse circulation port, and providing fluid communication between: i) the interior passageway uphole from the annular isolation device, and ii) the wellbore annulus downhole from the annular isolation device. 9. The method of claim 8, wherein the step of opening the reverse circulation port further comprises the step of dropping a drop-ball or caged ball to operate the reverse circulation sliding sleeve. 10. The method of claims 1-9, further comprising the step f), setting the liner hanger. 11. The method of claim 10, wherein the step f) is performed prior to completion of step e). 12. The method of claims 10-11, wherein step f) further comprises radially expanding an expandable liner hanger into gripping engagement with a casing positioned in the wellbore. 13. The method of claims 1-12, further comprising the step of running a cement plug downhole through the interior passageway at the end of step d). 14. The method of claim 13, further comprising the steps of closing the reverse circulation port using the cement plug and diverting fluid flow from the interior passageway above the cement plug to the liner hanger. 15. The method of claims 10-12, wherein the step of setting the liner hanger further comprises dropping a caged-ball. 16. The method of claims 1-15, further comprising step g), re-establishing conventional flow. 17. The method of claims 1-16, further comprising the step of un-setting the annular isolation device. 18. The method of claim 17, wherein the step of un-setting the annular isolation device further comprises mechanical manipulation of the tubing string. 19. The method of claims 1-18, further comprising the step of pulling the tubing string from the wellbore and leaving the liner in place downhole.

Exemplary methods of use of the invention are described, with the understanding that the invention is determined and limited only by the claims. Those of skill in the art will recognize additional steps, different order of steps, and that not all steps need be performed to practice the inventive methods described.

Persons of skill in the art will recognize various combinations and orders of the above described steps and details of the methods presented herein. While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

The invention claimed is:

1. A method of reverse circulation cementing of a liner in a wellbore extending through a subterranean formation, the method comprising the steps of:

a. running a tubing string into the wellbore so that a wellbore annulus is defined between the wellbore and the tubing string, the tubing string defining an interior passageway and having a reverse circulation assembly, a liner hanger, and a liner positioned downhole from the liner hanger;

b. circulating fluid conventionally during run-in by flowing fluid downhole from the surface through the interior passageway, through a bottom outlet of the liner, uphole along an exterior surface of the liner, and through the wellbore annulus to the surface;

c. setting an annular isolation device in the wellbore annulus between a casing positioned in the wellbore and the tubing string;

d. flowing cement along a reverse circulation path into the wellbore annulus below the annular isolation device and adjacent the exterior surface of the liner; and e. setting the liner hanger into engagement with the casing.

2. The method of claim 1, further comprising a step of f) setting the cement in the wellbore annulus about the liner.

3. The method of claim 1, wherein step c) further comprises setting a radially expandable annular isolation device in the wellbore annulus.

4. The method of claim 3, wherein the annular isolation device is set at a location in the wellbore having a casing, and wherein the annular isolation device is radially expanded to seal the wellbore annulus between the casing and the tubing string.

5. The method of claim 4, wherein the step of setting the annular isolation device further comprises increasing tubing pressure to set the annular isolation device.

6. The method of claim 1, wherein step d) comprises flowing fluid downhole through the interior passageway of the tubing string, into the wellbore annulus from the reverse circulation assembly, and downhole from the annular isolation device along the wellbore annulus and the exterior surface of the liner.

7. The method of claim 6, wherein step d) further comprises opening a reverse circulation port of the reverse circulation assembly to permit fluid communication between: i) the interior passageway uphole from the annular isolation device, and ii) the wellbore annulus downhole from the annular isolation device.

8. The method of claim 7, wherein the step of opening the reverse circulation port comprises dropping a drop-ball or caged ball to operate a reverse circulation sliding sleeve.

9. The method of claim 1, further comprising a step of g) setting the liner hanger.

10. The method of claim 9, wherein the step g) is performed prior to the completion of the step f).

11. The method of claim 9, wherein the step g) comprises radially expanding an expandable liner hanger into gripping engagement with the casing positioned in the wellbore.

12. The method of claim 1, further comprising the step of running a cement plug downhole through the interior passageway at the end of step d).

13. The method of claim 9, wherein the step of setting the liner hanger further comprises dropping a caged-ball.

14. The method of claim 9, further comprising a step of h) re-establishing conventional flow.

15. The method of claim 9, further comprising un-setting the annular isolation device.

16. The method of claim 15, wherein the step of un-setting the annular isolation device comprises mechanical manipulation of the tubing string.

17. The method of claim 16, further comprising pulling the tubing string from the wellbore and leaving the liner in place downhole.

18. A method of reverse circulation cementing of a liner in a wellbore extending through a subterranean formation, the method comprising the steps of:

running-in a tubing string defining an interior passageway along its length and having a reverse circulation assembly and a liner;

circulating fluid conventionally during run-in;

setting an annular isolation device in an annulus defined between a casing positioned in the wellbore and the tubing string;

flowing cement along a reverse circulation path into the annulus below the annular isolation device and adjacent the liner;

setting a liner hanger into engagement with the casing;

running a cement plug downhole through the interior passageway after flowing cement along the reverse circulation path into the annulus below the annular isolation device and adjacent the liner; and closing the reverse circulation port using the cement plug and diverting fluid flow from the interior passageway above the cement plug to the liner hanger.

* * * * *